US007152511B2

(12) United States Patent
Fen

(10) Patent No.: US 7,152,511 B2
(45) Date of Patent: Dec. 26, 2006

(54) POLYCHROME TRANSPARENT TOOL HANDLE

(76) Inventor: Shy Fen Fen, No. 2, Alley 11, Lane 790, Sec. 4, Yanhai Rd., Fusing Township, Changhua County (TW)

( * ) Notice: Subject to any disclaimer, the term of this patent is extended or adjusted under 35 U.S.C. 154(b) by 52 days.

(21) Appl. No.: 11/131,682

(22) Filed: May 17, 2005

(65) Prior Publication Data

US 2006/0260444 A1 Nov. 23, 2006

(51) Int. Cl.

| | |
|---|---|
| ***B25B 23/16*** | (2006.01) |
| ***B25G 1/00*** | (2006.01) |
| ***B25G 1/01*** | (2006.01) |
| ***B25G 1/08*** | (2006.01) |
| ***B25F 1/02*** | (2006.01) |
| ***B26B 1/00*** | (2006.01) |

(52) U.S. Cl. ..... 81/177.1; 81/489; 81/490; 7/167; 16/111.1; 16/902; 40/660; 40/661; 30/125

(58) Field of Classification Search ..... 81/177.1, 81/177.4, 489, 490, 492, 478, 450; 7/167; 16/110.1, 111.1, 422, 902; 29/242; 135/25.41; 446/266; 40/660, 661, 649, 651; 150/109; 30/125, 517

See application file for complete search history.

(56) References Cited

U.S. PATENT DOCUMENTS

| | | | | |
|---|---|---|---|---|
| 2,127,163 | A * | 8/1938 | Davis | 40/660 |
| 2,173,942 | A * | 9/1939 | Hiatt et al. | 40/660 |
| 2,176,698 | A * | 10/1939 | Albrecht | 40/660 |
| 2,187,192 | A * | 1/1940 | Albrecht | 40/661 |
| 5,168,600 | A * | 12/1992 | Huang | 16/111.1 |
| 5,390,572 | A * | 2/1995 | Gakhar et al. | 81/436 |
| 5,740,586 | A * | 4/1998 | Gomas | 16/436 |
| 5,964,009 | A * | 10/1999 | Hoepfl et al. | 16/430 |
| 6,230,366 | B1 * | 5/2001 | Lin | 16/431 |
| 6,295,903 | B1 * | 10/2001 | Tipper et al. | 81/489 |
| 2005/0115023 | A1 * | 6/2005 | Lin | 16/110.1 |

FOREIGN PATENT DOCUMENTS

JP 05069347 A * 3/1993

* cited by examiner

*Primary Examiner*—Joseph J. Hail, III
*Assistant Examiner*—Bryan R. Muller
(74) *Attorney, Agent, or Firm*—Charles E. Baxley

(57) ABSTRACT

A polychrome transparent tool handle comprises a base, an identifying member, a plug, an ear member, a plurality of arcuate members and a cladding layer. The colors of the identifying member, the arcuate members and the cladding layer are different, the handle is made of light-transmitting plastic and interiorly received the identifying member, so that the identifying member is visible from the outside of the base of the identifying member. The ear member and the plug are disposed at an end of the base, while at another end of the base is fixed a tool head. The arcuate members are positioned on the peripheral surface of the base and are laminated with a cladding layer, and the arcuate members partially projects out of the cladding layer.

3 Claims, 5 Drawing Sheets

POLYCHROME TRANSPARENT TOOL HANDLE

BACKGROUND OF THE INVENTION

1. Field of the Invention

The present invention relates to a hand tool product, and particularly to a polychrome transparent tool handle.

2. Description of the Prior Arts

Hand tools are widely used in different fields and the demand for it is quite big, and most of the hand tools (such as screwdriver) are provided with a handle for grip, and on the handle is also fixed a tool head.

Conventionally, a tool handle is made by monochrome plastic ejection, and on the peripheral surface of the tool handle is provided with a printed layer (printed with the name of manufacture, trademark, specification of the tool head, and the like information), or the trademark is directly impressed on the handle.

However, the printed layer is likely to be erased after a certain period of use since the handle needs to be constantly gripped and rubbed by the user during application.

The impressed trademark also has a light reflection problem due to the handle is monochromic, reading the trademark correctly and clearly requires the user to rotate the handle to a specific angle at which the reflection doesn't occur. Moreover, both the monochrome handle and its printed layer are dull in color. Therefore, the conventional handle can't attract consumer attention.

The present invention has arisen to mitigate and/or obviate the afore-described disadvantages.

SUMMARY OF THE INVENTION

The primary objective of the present invention is to provide a polychrome tool handle that can attract consumer attention.

The secondary objective of the present invention is to provide a polychrome tool handle whose identifying information can be kept from being erased after long time of use.

A polychrome transparent tool handle in accordance with the present invention comprises a base, an identifying member, a plug, an ear member, a plurality of arcuate members and a cladding layer. The identifying member, the arcate members and the cladding layer have a different color, the handle is made of light-transmitting plastic and is interiorly disposed with the identifying member, so that the identifying member is visible from the outside of the base of the identifying member. The ear member and the plug are disposed at an end of the base, while at another end of the base is fixed a tool head. The arcuate members are positioned on the peripheral surface of the base and then are laminated with a cladding layer, and the arcuate members partially projects out of the cladding layer.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
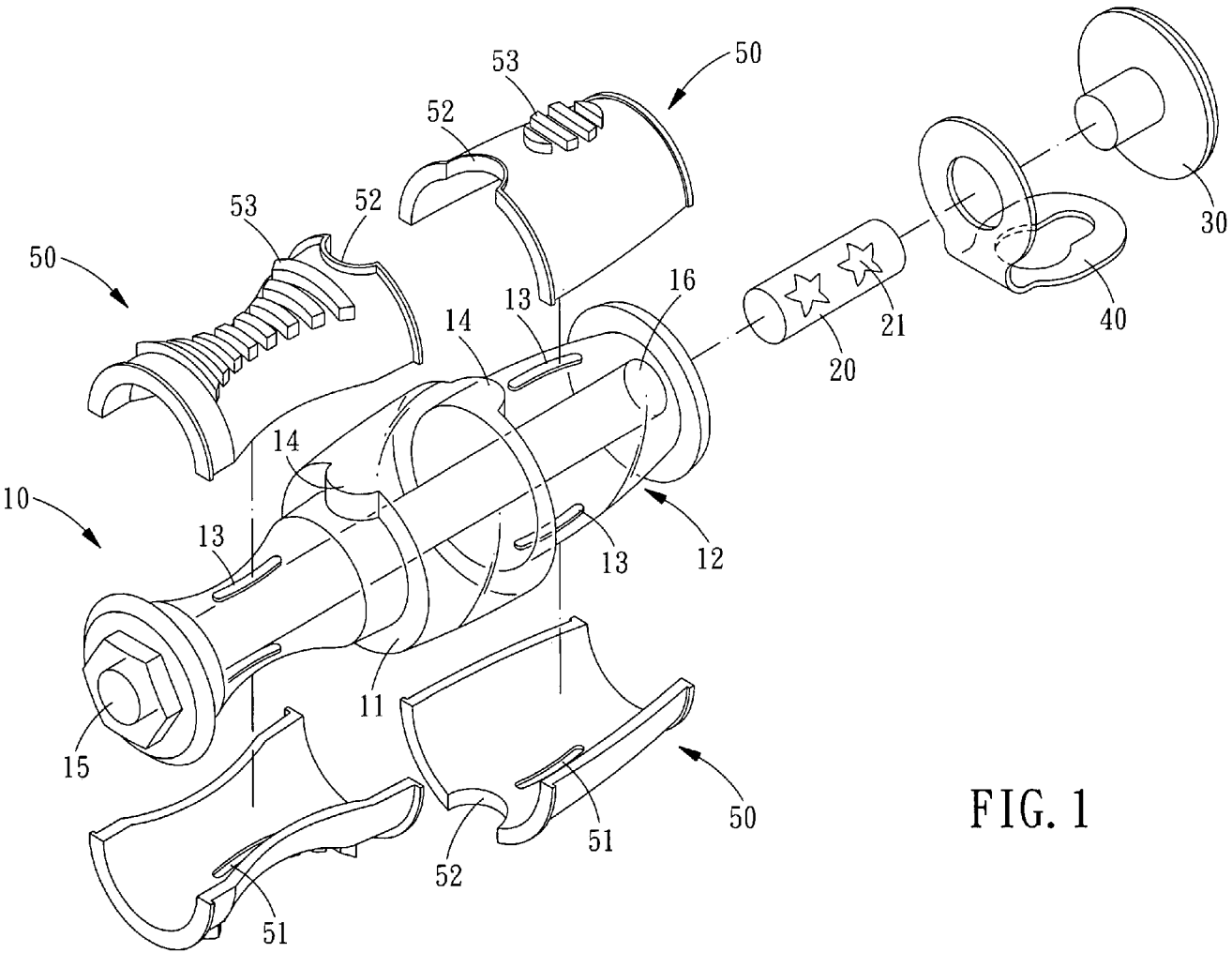
FIG. 1 is an exploded view of a part of a polychrome transparent tool handle in accordance with the present invention.
Figure 2:
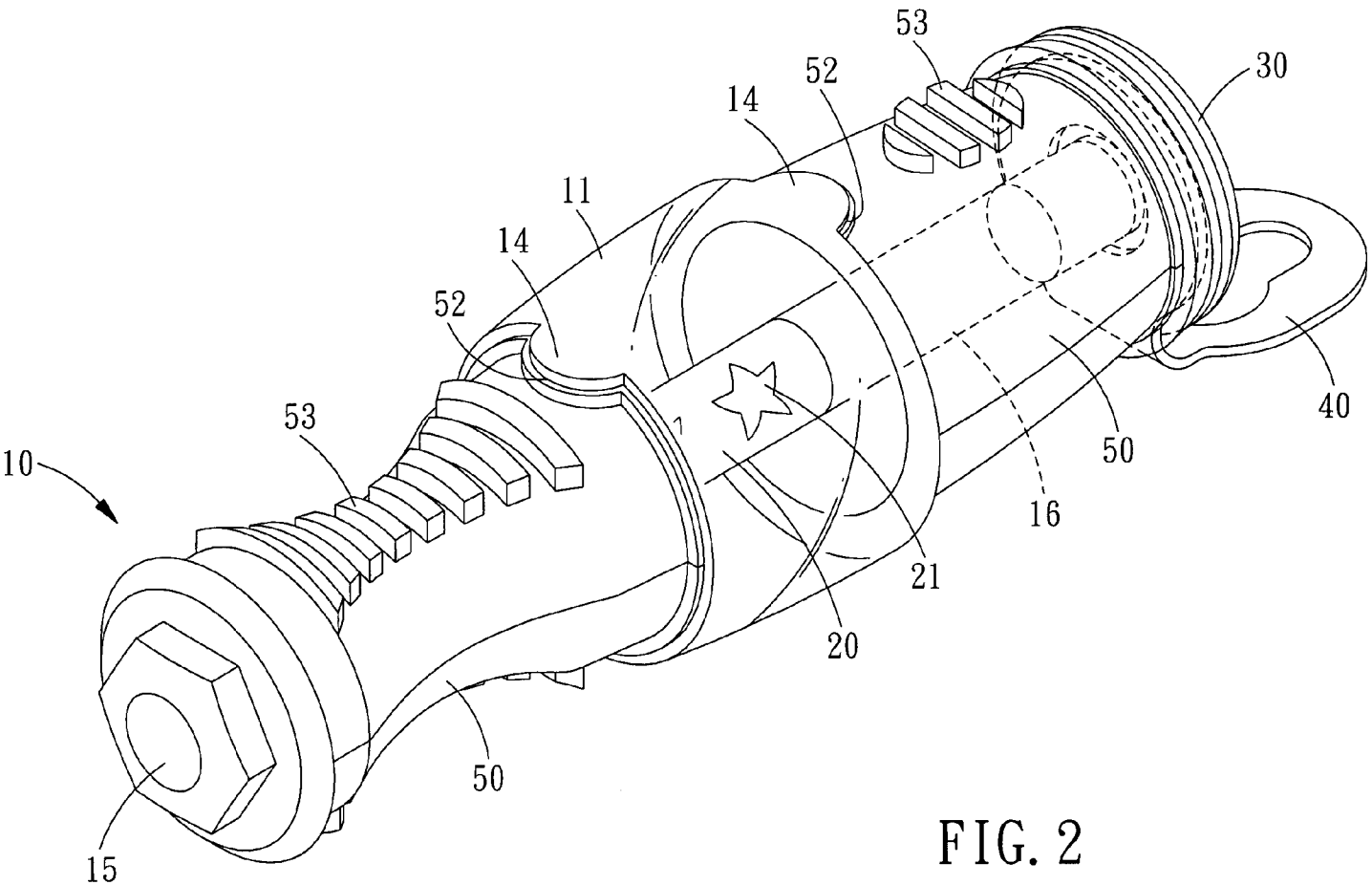
FIG. 2 is an assembly view of a part of the polychrome transparent tool handle in accordance with the present invention.
Figure 3:
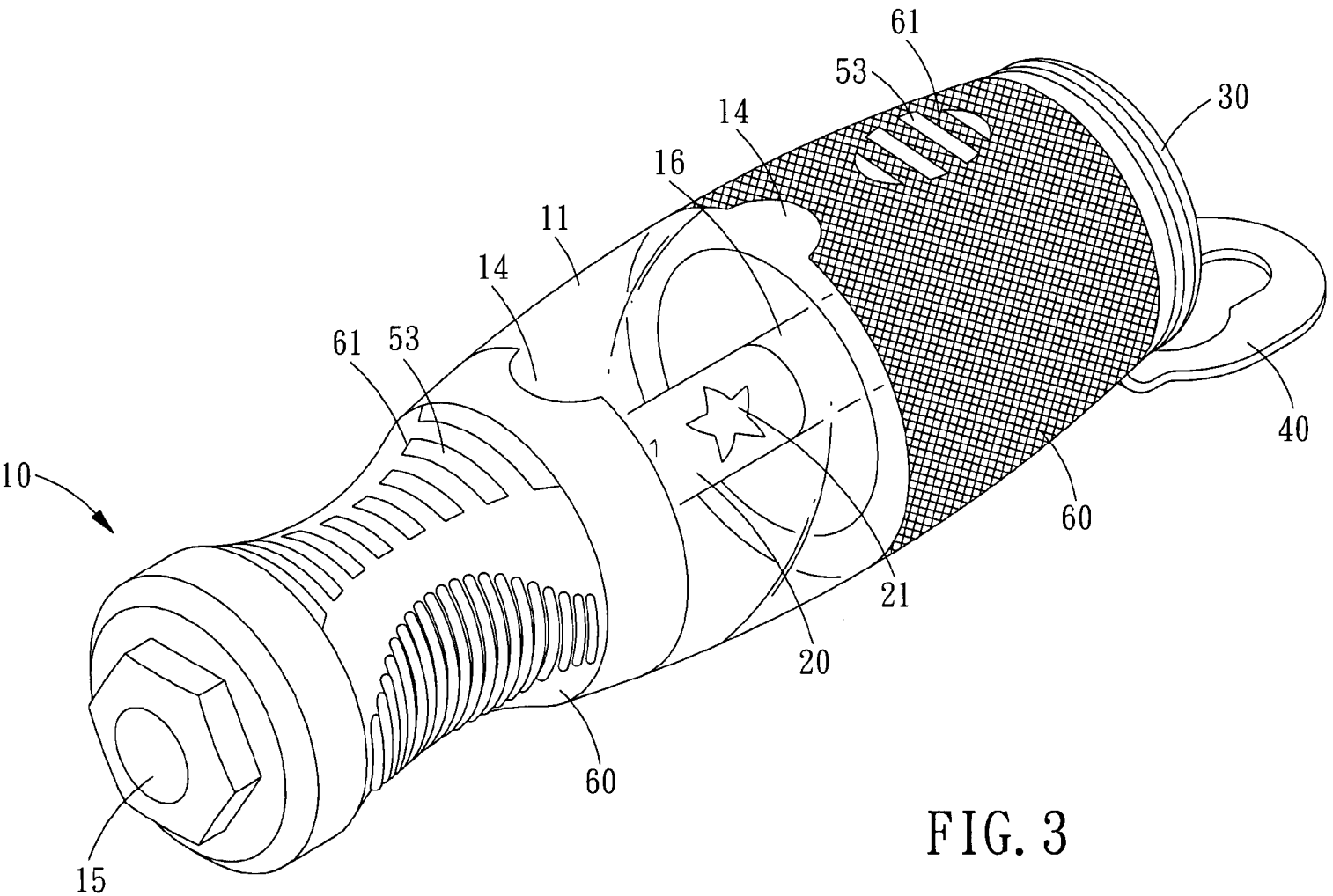
FIG. 3 is a perspective view of the polychrome transparent tool handle in accordance with the present invention.

Referring to FIGS. 1–3, a polychrome transparent tool handle in accordance with the present invention comprises a base 10, an identifying member 20, a plug 30, an ear member 40, a plurality of arcate members 50 and a cladding layer 60.

Figure 4:
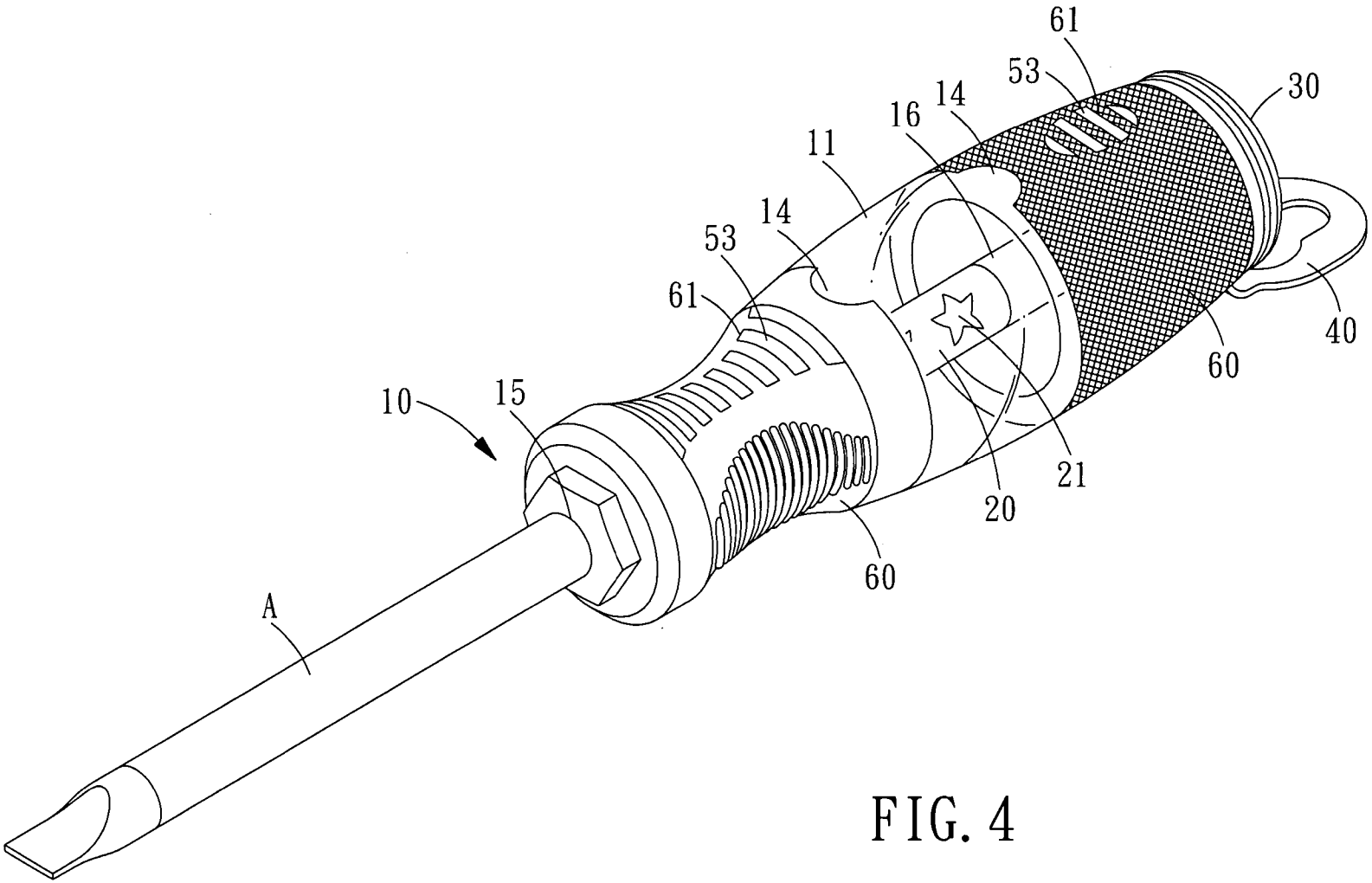
FIG. 4 shows the polychrome transparent tool handle in accordance with the present invention is combined with a slot screwdriver.

The base 10 is made of light-transmitting plastic and includes a viewing portion 11 and two annular grooves 12 located beside the viewing portion 11. In each of the annular grooves 12 are formed two opposite elongated positioning projections 13. At the connecting portion between the viewing portion 11 and the annular grooves 12 are arranged two opposite semicircular stopping projections 14. The base 10 is provided at each end thereof with a positioning aperture 15 and a receiving aperture 16, respectively that are in communication with each other. The inner wall of the receiving aperture 16 is located inside the viewing portion 11, while the positioning aperture 15 is provided for insertion of a tool head A, as shown in FIG. 4, the tool head A is a slot type screwdriver, for example.

The identifying member 20 is rod-shaped and is formed on its peripheral surface with an identifying portion 21 which shows the name of manufacture, trademark, specification of the tool head or other information. The identifying portion 21 is located in the receiving groove 16 of the base 10 and is visible through the viewing portion 11 of the base 10.

The plug 30 is inserted in the receiving groove 16 of the base 10.

The ear member 40 is mounted on the shaft of the plug 30 and positioned between the receiving groove 16 of the base 10 and the plug 30 for hanging the tool.

There are four arcuate members 50 in this embodiment, for example, and the arcuate members 50 has a second color which is different from the first color of the identifying member 20. Each of the arcuate members 50 is formed with a positioning cavity 51 and a stopping gap 52 that are located at the inner surface and the end thereof, respectively, for mating with the positioning projections 13 and the stopping projections 14 of the base 10, so that the respective arcuate members 50 are received in the annular grooves 12 of the base 10 and are closely jointed to one another. On the surface of the respective arcuate members 50 are formed a plurality of elongated ribs 53 that are equidistantly spaced.

The cladding layer 60 is made of soft plastic through ejection molding process and has a third color that is different from the first color of the identifying member 20 and the second color of the arcuate members 50. The cladding layer 60 is laminated on the respective arcuate members 50 through plastic ejection molding process, and a plurality of through apertures 61 are formed on the cladding layer 60 for passage of the respective ribs 53 of the arcuate members 50, so that the ribs 53 will project out of the through apertures 61 once the cladding layer 60 is fixed.

For a better understanding of the present invention, its operation and function, references should be made to FIGS. 1–4, since the base 10 is made of light-transmitting plastic and is formed at the end thereof with the receiving groove 16 in which are arranged the identifying member 20 whose identifying portion 21 is visible through the viewing portion 11 of the base 10, allowing the user to read the trademark, the specification of the tool head A and other information shown on the identifying portion 21.

Therefore, the information on the identifying portion 21 of the identifying member 20 will not erased, after a certain period of use, since it is protected by the base 10.

In addition, the identifying member 20, the arcuate members 50 and the cladding layer 60 have different colors, plus the base 10 is made of light-transmitting plastic, so that the user can see the identifying member 20 directly through the viewing portion 11 of the base 10. And the plurality of through apertures 61 are formed on the cladding layer 60 for passage of the respective ribs 53 of the arcuate members 50, so that the ribs 53 will project out of the through apertures 61 once the cladding layer 60 is fixed. Therefore, an attractive polychrome handle is formed.

Furthermore, the base 10 is formed with positioning projections 13 and stopping projections 14, plus the arcuate members 50 provided with positioning cavities 51 and stopping gaps 52 for mating with the positioning projections 13 and the stopping projections 14 of the base 10, so that the respective arcuate members 50 are received in the annular grooves 12 of the base 10 and are closely jointed one another.

Since the cladding layer 60 is made of soft injection molded plastic, it can provide a more comfortable grip.

Figure 5:
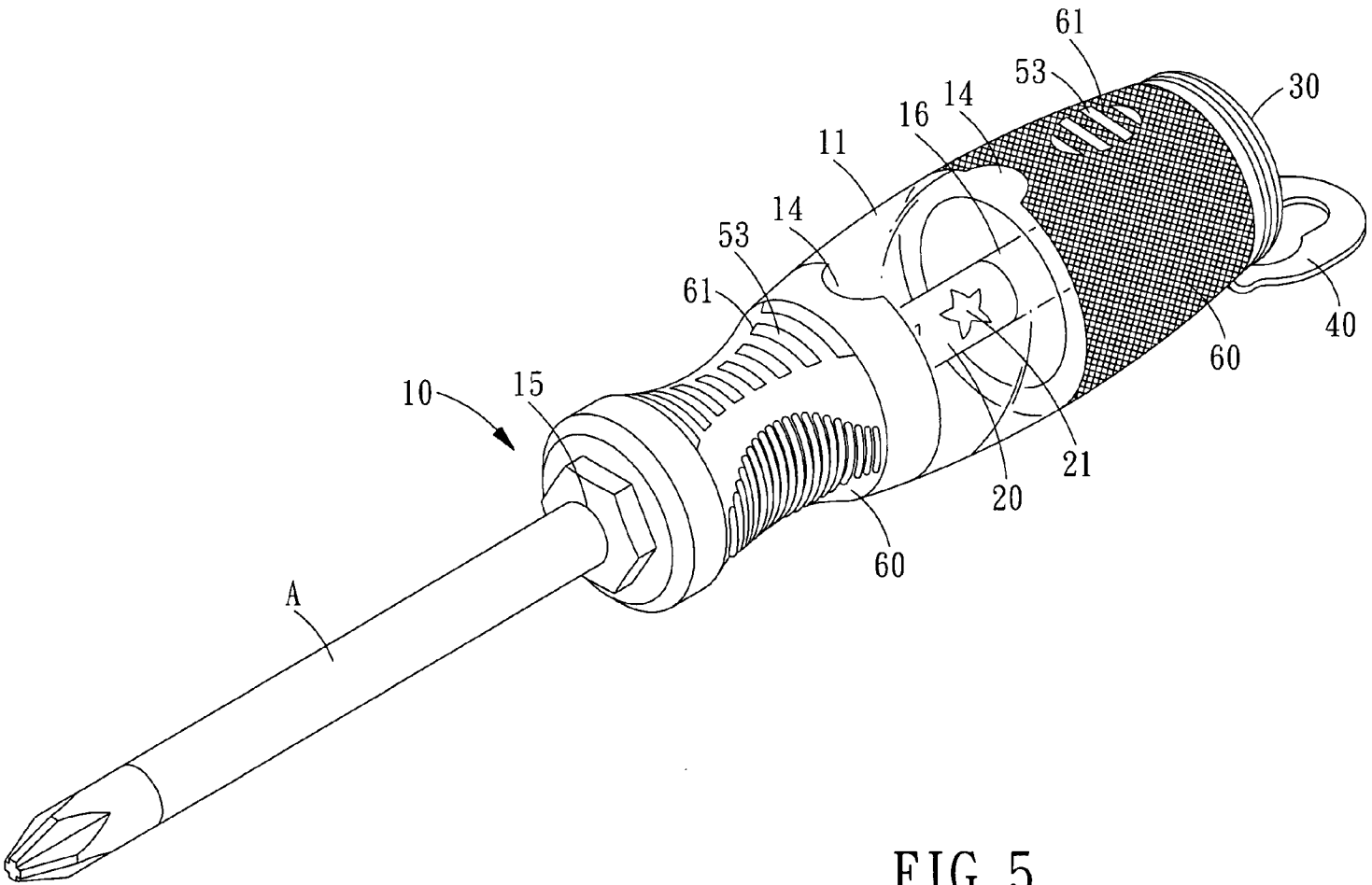
FIG. 5 shows the polychrome transparent tool handle in accordance with the present invention is combined with a Philips screwdriver

Referring to FIG. 5, the tool head A received in the positioning groove 15 of the base 10 is a Philips screwdriver.

The identifying member in this embodiment is of circular shape, it also can be hexagonal or any other geometric shape in cross section.

While we have shown and described various embodiments in accordance with the present invention, it should be clear to those skilled in the art that further embodiments may be made without departing from the scope of the present invention.

What is claimed is:

1. A polychrome transparent tool handle comprising:

a base made of light-transmitting plastic and including a viewing portion and annular grooves, each end of the base being provided with a positioning aperture and a receiving aperture, respectively, an inner wall of the receiving aperture being located inside the viewing portion, the positioning aperture provided for insertion of a tool head;

an identifying member having a first color and being formed on its peripheral surface with an identifying portion, wherein the identifying portion is located in the receiving groove of the base and is visible through the viewing portion of the base;

a plug inserted in the receiving groove of the base;

an ear member positioned by the receiving groove as a hanging tool;

a plurality of arcuate members, wherein each of the arcuate members has a second color that is different from the first color of the identifying member, wherein the respective arcuate members are received in the annular grooves of the base and are closely jointed to one another, on a surface of the respective arcuate members are formed a plurality of ribs; and a cladding layer has a third color that is different from the first color of the identifying member and the second color of the arcuate members, and a plurality of through apertures are formed on the cladding layer for passage of the respective ribs of the arcuate members, so that the ribs will project out of the through apertures once the cladding layer is fixed to each respective arcuate member, the cladding layer is laminated on the respective arcuate members through plastic ejection molding process, thus forming a polychrome tool handle.

2. The polychrome transparent tool handle as claimed in claim 1, wherein elongated positioning projections are formed the annular grooves of the base, and each of the arcuate members is formed with a positioning cavity for mating with the elongated positioning projections of the base, so that the respective arcuate members are firmly positioned in the annular grooves of the base.

3. The polychrome transparent tool handle as claimed in claim 1, wherein stopping projections are arranged at a connecting portion between the viewing portion and the annular grooves, and each of the arcuate members is formed with a stopping gap for mating with the stopping projections of the base, so that the respective arcuate members are firmly positioned in the annular grooves of the base.

* * * * *